US010902757B2

(12) United States Patent
Ross

(10) Patent No.: US 10,902,757 B2
(45) Date of Patent: Jan. 26, 2021

(54) SIGN ILLUMINATION SYSTEM AND FASTENING DEVICE WITH INTEGRAL ILLUMINATION

(71) Applicant: Tyler J Ross, Warrenton, VA (US)

(72) Inventor: Tyler J Ross, Warrenton, VA (US)

( * ) Notice: Subject to any disclaimer, the term of this patent is extended or adjusted under 35 U.S.C. 154(b) by 0 days.

(21) Appl. No.: 15/976,286

(22) Filed: May 10, 2018

(65) Prior Publication Data

US 2018/0330643 A1 Nov. 15, 2018

Related U.S. Application Data

(60) Provisional application No. 62/504,605, filed on May 11, 2017.

(51) Int. Cl.

| | |
|---|---|
| ***G09F 13/02*** | (2006.01) |
| ***G09F 13/22*** | (2006.01) |
| ***G09F 13/00*** | (2006.01) |
| ***F21V 23/04*** | (2006.01) |
| ***F21V 14/02*** | (2006.01) |
| ***G09F 7/18*** | (2006.01) |
| *F21Y 115/10* | (2016.01) |

(52) U.S. Cl.

CPC ..... *G09F 13/02* (2013.01); *F21V 14/02* (2013.01); *F21V 23/0464* (2013.01); *G09F 7/18* (2013.01); *G09F 13/005* (2013.01); *G09F 13/22* (2013.01); *F21Y 2115/10* (2016.08); *G09F 2013/222* (2013.01)

(58) Field of Classification Search

CPC ..... G09F 13/02; G09F 2013/222

See application file for complete search history.

(56) References Cited

U.S. PATENT DOCUMENTS

| | | | | |
|---|---|---|---|---|
| 3,111,782 | A * | 11/1963 | Quigley | G09F 13/02 40/617 |
| 4,037,341 | A * | 7/1977 | Odle | G09F 13/02 40/559 |
| 5,988,100 | A * | 11/1999 | Schmitt | G09F 17/00 116/173 |
| 6,004,002 | A * | 12/1999 | Giannone | F21S 9/032 362/183 |
| 6,263,601 | B1 | 7/2001 | Emert | |
| 6,942,366 | B2 | 9/2005 | Mohacsi | |
| 7,422,348 | B1 * | 9/2008 | Yates, II | G09F 13/02 362/184 |
| 2007/0159817 | A1 * | 7/2007 | Evans | G09F 13/02 362/191 |
| 2007/0165407 | A1 * | 7/2007 | Schoning | G09F 9/35 362/276 |
| 2007/0236924 | A1 * | 10/2007 | Personius | G09F 7/22 362/183 |
| 2010/0226121 | A1 * | 9/2010 | Holman | F21S 8/086 362/183 |

(Continued)

*Primary Examiner* — Gary C Hoge

(74) *Attorney, Agent, or Firm* — Charter IP LLC; Matthew J. Lattig

(57) ABSTRACT

In a combination that may be realized as a sign illumination system, the combination includes a fastener adapted to couple two objects together. The fastener has a body and one or more fastening elements attachable to both objects thereon. An illumination unit may be removably coupled to the fastener, a light source thereof configurable to direct light at variable angles onto at least one of the two objects.

13 Claims, 4 Drawing Sheets

(56) References Cited

U.S. PATENT DOCUMENTS

| | | | | |
|---|---|---|---|---|
| 2012/0201017 | A1* | 8/2012 | Lamm | F21S 9/037<br>362/183 |
| 2014/0185314 | A1* | 7/2014 | Schattinger | G09F 13/02<br>362/602 |
| 2014/0375532 | A1* | 12/2014 | Chien | H05B 33/08<br>345/77 |
| 2017/0148363 | A1* | 5/2017 | Frycz | G09F 13/18 |
| 2018/0108282 | A1* | 4/2018 | Mullett | G09F 13/18 |
| 2019/0035312 | A1* | 1/2019 | Killion | G09F 13/18 |
| 2019/0096294 | A1* | 3/2019 | Yoshioka | G09F 13/04 |

* cited by examiner

SIGN ILLUMINATION SYSTEM AND FASTENING DEVICE WITH INTEGRAL ILLUMINATION

CROSS-REFERENCE TO RELATED APPLICATIONS

The present application claims the benefit under 35 U.S.C. § 119(e) of U.S. Provisional Patent Application Ser. No. 62/504,605 to Tyler J. Ross, filed May 11, 2017. The entire contents of this provisional application is hereby incorporated by reference herein.

BACKGROUND

Field

The example embodiments in general are directed to a sign illumination system and to a fastening device with integral illumination.

SUMMARY

An example embodiment of the present invention is directed to a sign illumination system. The system may include a frame structure configured to support signage thereon or therein. The frame structure is further configured to be anchored in a ground surface or on a vertical wall surface. The system includes at least one fastener device connected to the frame structure. This at least one fastener device has a body with one or more fastening elements thereon that are adapted to be attached to the signage for supporting the signage on the frame structure. The body may further include an illumination unit integral therewith that is configured to direct light onto the signage.

Another example embodiment is directed to a fastening device with integral illumination for attaching first and second objects to one another. The device has a body and includes one or more fastening elements attached to or integrated as a part thereof. The fastening elements are adapted for attachment to one or both of the first and second objects. The device may further include an illumination unit integrally formed as a portion of the body and configured to direct light onto at least one of the first and second objects.

Another example embodiment is directed to a combination. The combination includes a fastener adapted to couple two objects together, the fastener having a body and one or more fastening elements attachable to both objects thereon, wherein one of the two objects is a supporting structure, frame, or bracket and the other is a sign, poster, or placard, and an illumination unit that is removably coupled to the fastener. A light source of the illumination unit is configurable so as to direct light at variable angles onto at least one of the two objects. The illumination unit further includes one or more LED elements that are battery-powered or solar panel-powered, functionality providing automatic turn-on at night and turn-off at sunrise, and a motion sensor that energizes its light source upon detected movement.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 2:
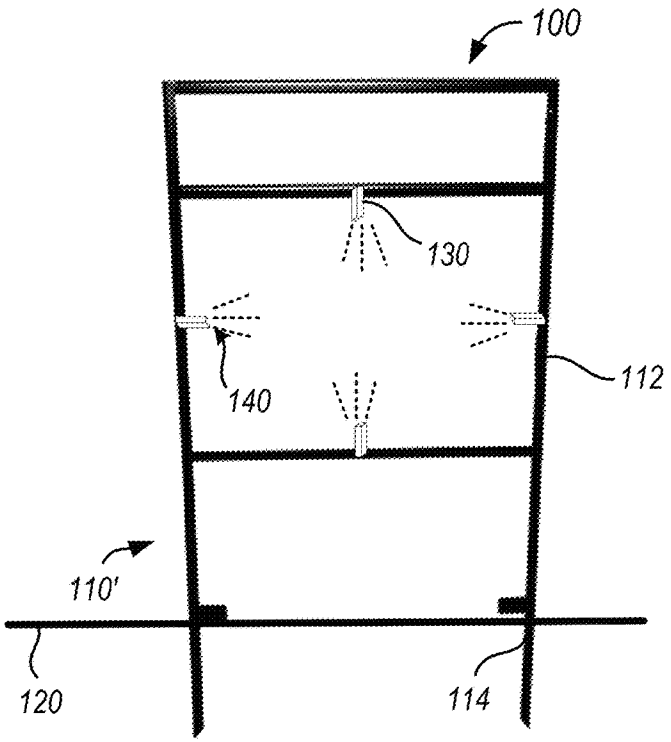
FIG. 2 is a plan view of a sign illumination system according to another example embodiment.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

The example embodiments hereafter describe in general, a sign illumination system having a frame structure configured to be anchored in a ground surface or on a vertical wall surface, whereby at least one fastener device is either integrally formed as part of or removably attachable to the frame structure. A body of the fastener device, in addition to including fastening elements thereon to be attached between signage and frame structure, also includes an illumination unit integral therewith that is configured to direct light onto the signage. Other embodiments are directed to a fastening device with integral illumination and to a combination configured to attach one object to another.

Figure 1:
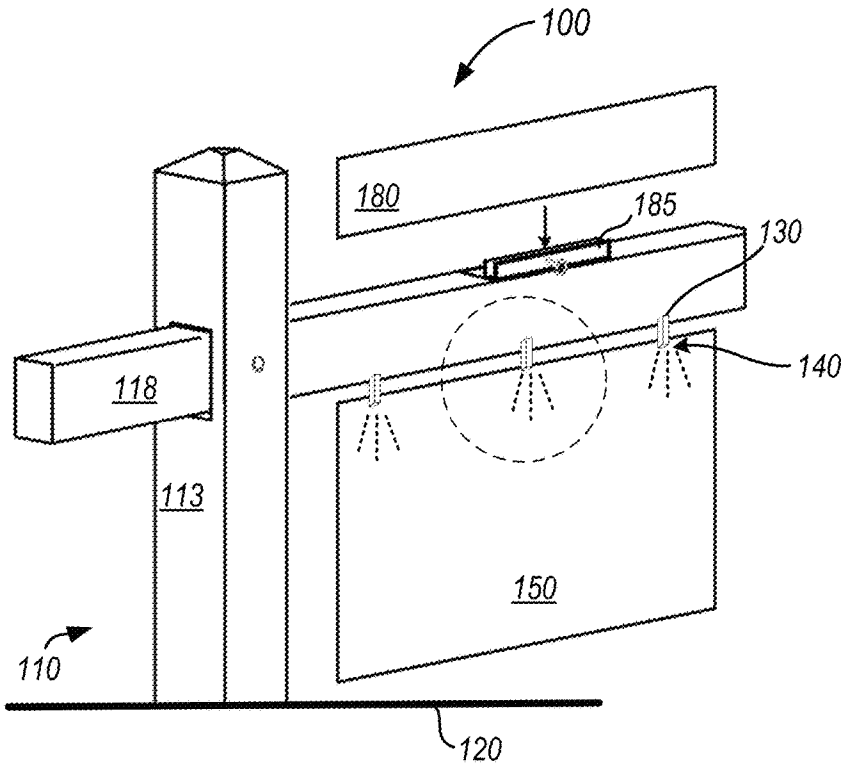
FIG. 1 is a plan view of a sign illumination system according to an example embodiment.

Referring now to FIGS. 1-4, the sign illumination system 100 may comprise a frame structure 110 that is configured to support signage 150 such as a sign, poster, placard, and the like thereon or therein. FIGS. 1 and 2 show frames structures 110, 110' anchored in a ground surface 120. In another example, a frame structure 110" may be anchored, attached to or otherwise arranged on a vertical wall surface 125; see for example FIG. 4.

Figure 4:
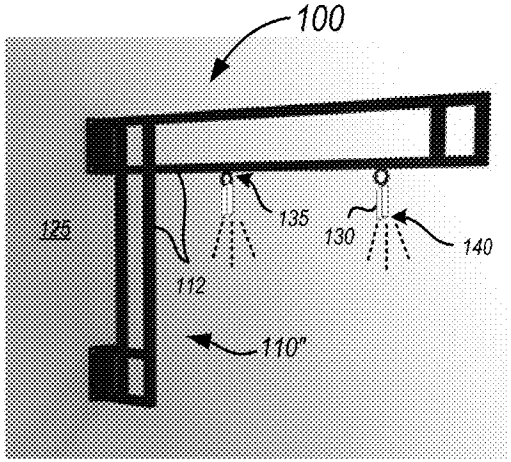
FIG. 4 is a plan view of a sign illumination system according to another example embodiment.
Figure 7:
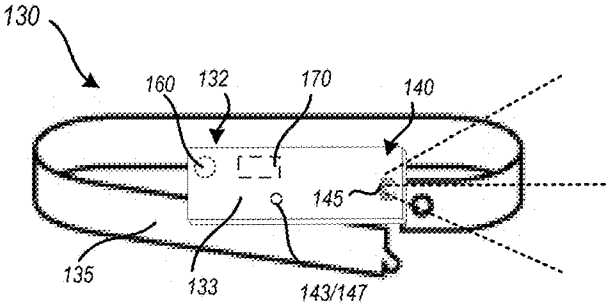
FIG. 7 is a top plan view of another example fastening device with illumination.

Frame structure 110 may include a vertical support post 113 adapted to be anchored in the ground surface 120 with a perpendicular arm 115 attached thereon. Frame structure may also have a rider 180 removably attached thereto by a clip fastener 185. As shown, a plurality of fastener devices 130 with illumination units 140 are arranged between one of the vertical support post 113 and/or perpendicular arm 115 and the signage 150. Alternatively, in FIG. 2, the frame structure 110' may be embodied as a generally rectangular-shaped frame 112 with one or more vertical extensions 114 attached thereto or formed therein adapted to be anchored in the ground surface 120. Here, the fastener devices 130 with illumination units 140 are fixedly attached or removably attachable between one or more sides of the rectangular frame 112 and the signage 150. In a further variation, as shown in FIG. 4, a connector portion of the body of the fastener devices 130 may be integrally formed as part of any example frame structure 110, 110', or 110".

Thus, the one or more fastener devices 130 are connected to or otherwise integrally formed as part of the frame structure 110, 110', 110", etc. The at least one fastener device 130 comprises a device body 132 with one or more fastening elements 135 thereon. In various examples, these fastening elements 135 may incorporate features of a group of fasteners comprising single or double-sided carabiner clips, S-shaped clips, spring clips, H or Y-shaped rider clips, eye-hook screws, and the like. Some of these variations are shown in FIGS. 1 and 5 through 9. Fastening elements 135 are adapted to be attached to the signage 150 so as to connect and/or support signage 150 on the frame structure 110.

Figure 3:
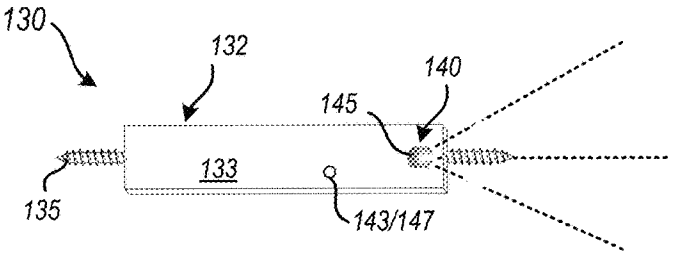
FIG. 3 shows an enlarged view of the fastener device with illumination in FIGS. 1 and 2.
Figure 6:
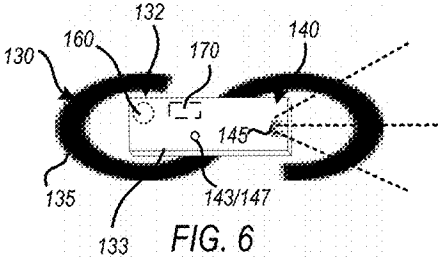
FIG. 6 is a top plan view of another example fastening device with illumination.
Figure 9:
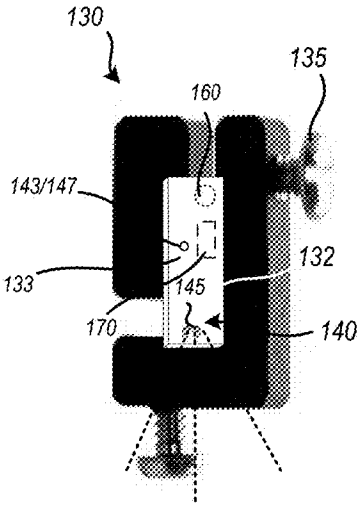
FIG. 9 is a top plan view of another example fastening device with illumination.
Figure 5:
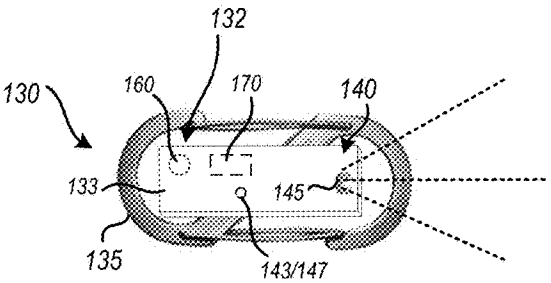
FIG. 5 is a top plan view of one example fastening device with illumination.
Figure 8:
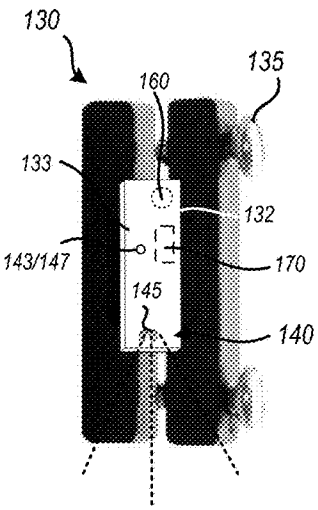
FIG. 8 is a top plan view of another example fastening device with illumination.

As shown best in FIG. 3, in this embodiment the device body 132 of fastener device 130 includes an illumination unit 140 integral therewith that is configured to direct light onto the signage 150. In one example, the light source 145 of illumination unit 140 may be embodied as one or more light emitting diode (LED) elements that are battery-powered or solar panel-powered. The example embodiments are not limited to LEDs, as incandescent and fluorescent elements are foreseeable; for purposes of explanation only the light source is represented by LED elements 145.

The LED elements 145 may in on example be white LEDs, but may be of any available color including, for example, red, orange, yellow, green, and blue. LED elements 145 may optionally include reflectors, diffusers, lenses, filters, and/or polarizers to modify and/or direct the light. An example of this type of LED is a NICHIA® Chip Type white 3.3 volt LED (model no. NS3W183T-H1) available from NICHIA Corp. of Detroit, Mich.

The LED elements 145 may in one example have an illuminance of about 5-6 lux at a drive current of 8 milliamps when measured at a distance of 14 inches from the light source. At this level of luminous flex, the illumination unit 140 provides an intensity of light that is sufficient to illuminate an object or surface such as signage 150 (i.e., it provides enough light to allow a user to see the object) as opposed to an amount of light that simply allows the light source to be seen.

Although shown generally rectangular-shaped, device body 132 in one example may include an outer housing 133 having an end cap 134 at one end covering an internal cavity for receiving a source of electrical power for illumination unit 140, e.g., one or more replaceable or rechargeable batteries 160, and a printed circuit board (PCB) 170 which controls the LED elements 145. Example batteries 160 include coin cell or button batteries, widely available in a variety of diameters and thicknesses, but which are generally thin as compared to their diameter. Such batteries have first and second opposed major surfaces that serve as the positive (+) and negative (−) terminals of the battery. A button cell battery for powering illumination unit 140 and internal circuitry on PCB 170 within the device body 132 may be a DURACELL® DL2032 3V lithium coin cell battery. In a specific embodiment, a 3-volt battery may be used with a 3.3 volt LED. In this situation, the LED is under powered, thereby increasing the life of the LED. In lieu of batteries 160, one or more solar panels 160' may be electrically connected to the PCB 170 so as to provide power to system 100.

Additionally, illumination unit 140 (given its LED circuitry) may include a sensor such as photocell 143 connected to PCB 170 and which is battery or solar-panel powered, so as to realize automatic turn-on at night and turn-off at sunrise capabilities (a "dusk-to-dawn" sensor). Lights with dusk-to-dawn sensors such as photocell 143 work by sensing the amount of natural light and turn on only when the natural light has reached particular level of dimness. Illumination units with such sensors thus work only during the darkest hours of the day and will automatically switch themselves off in the morning. In one example, illumination unit 140 may include a combination of two sensors, i.e., combining a dusk-to-dawn photocell with a motion detector 147, one example being a passive infra-red (PIR) detector that detects movement.

Photocell configurations all use the same underlying semiconductor technology to control electric current. Under normal conditions, semiconductors do not conduct electricity, but when exposed to sufficient light, current starts to flow. In some examples, the photocell 143 function may be adjustable so the light level that will activate the semiconductor can be selected.

Accordingly, the dusk-to-dawn function is a common use for a photocell, since as it senses ambient light levels, the photocell automatically adjusts to seasonal changes in the day/night cycle and is unaffected by daylight-saving time. As the LED elements 145 are battery or solar-panel powered, the same power source(s) power photocell 143; as such no wiring is required.

In lieu of automatic lighting by incorporating a photocell 143, illumination unit 140 may include only a motion detector 147 that mounted on device body 132 and electrically connected to PCB 170 within. Motion detector 147 is adapted to energize the light source (LED elements 145) upon detected movement. The main difference between a photocell and a motion detector is that the former detects changing light levels while the latter reacts to physical movement. Motion detector 147 may be either an active or passive sensor. Active sensors emit light, radio, or ultrasonic sound. Movement in the detection area changes the reflected signals and activates the sensor, and in some configurations an active sensor can even sense motion around corners. Passive motion sensors such as the aforementioned PIR detector detect infrared energy given off by warm objects such as animals or people. As these "warm spots" move, the passive sensor and any connected electrical circuit is triggered.

Figure 10:
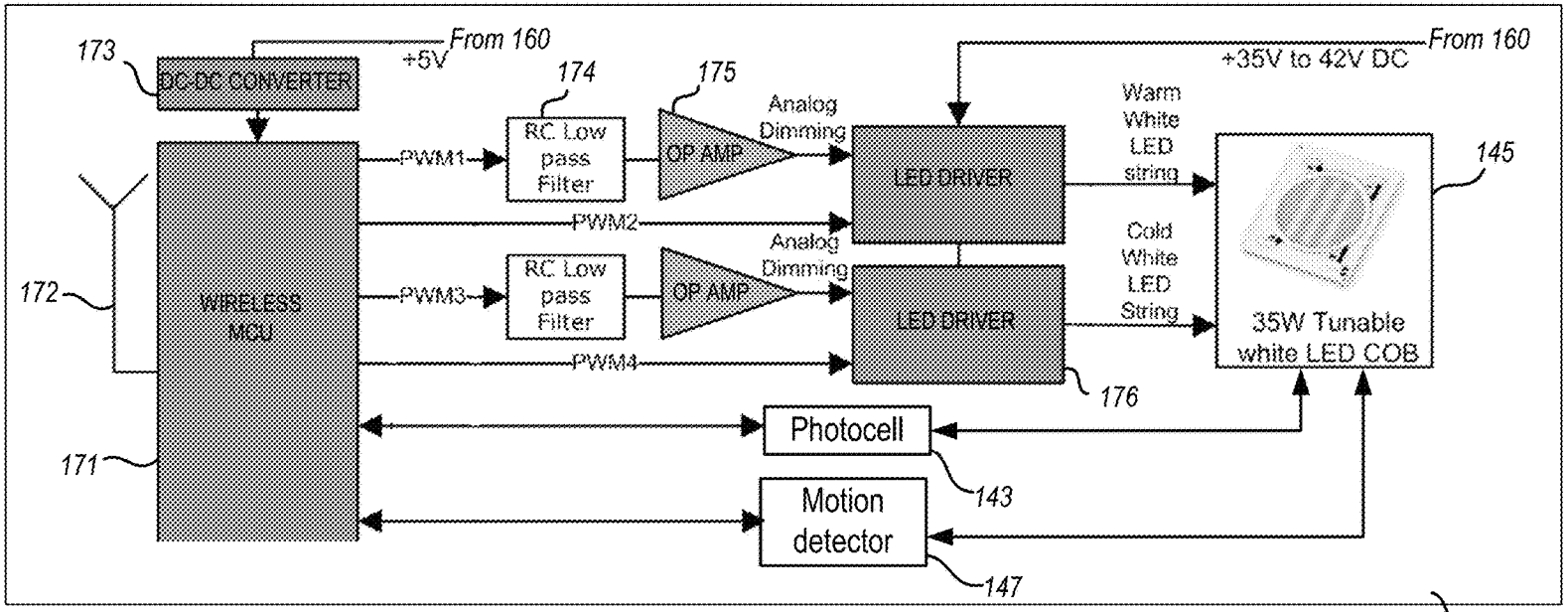
FIG. 10 is a block diagram of the circuit board of the example system.
Figure 12:
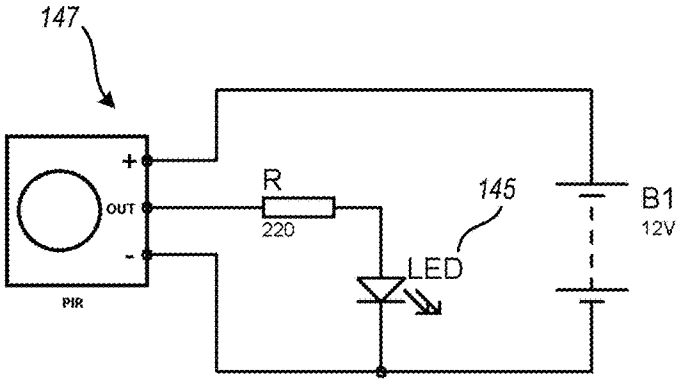
FIG. 12 is a block diagram of a motion detector according to the example embodiments.

FIG. 10 illustrates an example block diagram of the circuit board and interfaces to photocell 143 and/or motion detector 147 according to the example embodiments. Today, the focus of lighting is currently shifting from simply illuminating areas with constant light output to providing quality and controlled light output. High quality lighting with adjustable intensity and adjustable color temperature plays a key role in enhancing the architecture. Dimming combined with the daylight sensing helps to increase the energy efficiency as well. To change the color temperature of white light, the designer can implement a combination of warm LEDs (color temperature of around 2500 K) and cold LEDs (color temperature of around 5700 K).

Although only an exemplary construction, the block diagram of circuit board 170 is modeled after TEXAS INSTRUMENTS® Tunable White-LED DC-DC driver with BLUETOOTH® Smart Connectivity, model TIDA-01096 TI design. Referring now to FIG. 10, the circuit board 170 includes a wireless microcontroller unit (MCU) 171. MCU 171 targets BLUETOOTH® SMART, ZIGBEE®, 6LOWPAN, and ZIGBEE RF4CE remote control applications, permitting control of the LED elements 145 of illumination unit form a remote location. MCU 171 is an ultra-low-power, 2.4-GHz RF device and includes RF transceiver 172, each powered via the battery 160 through DC-DC converter 173. The very-low active RF and MCU current and low-power mode current consumption provide excellent battery 160 lifetime and allow for operation on small coin cell batteries and in energy-harvesting applications.

Figure 11:
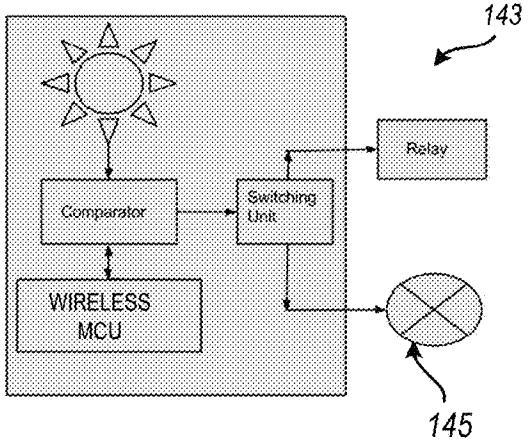
FIG. 11 is a block diagram of a photocell according to the example embodiments.

MCU 171 in an example may contain a 32-bit ARM CORTEX™-M3 processor that runs at 48 MHz as the main processor. Optionally, MCU 171 may include an ultra-low-power sensor controller (not shown), which is ideal for interfacing external sensors such as photocell 143 and motion detector 147, and for collecting analog and digital data autonomously while the rest of the system is in sleep mode. FIG. 11 and show block diagrams of the respective photocell 143 and motion detector 147 according to the example embodiments.

After receiving pulse-width modulated controls signals via RC low pass filters 174, the low-noise operational amplifiers (OP AMPS 175) provide outstanding DC precision and AC performance. Rail-to-rail input and output, low offset (25 μV maximum), low noise (7.5 nV/√Hz), quiescent current of 950 μA (maximum), and a 5.5-MHz bandwidth make OP AMPS 174 attractive for a variety of precision and portable applications. In addition, OP AMP 174 has a reasonably wide supply range with excellent power supply rejection ratio (PSRR), which makes it desirable for applications that run directly from batteries 160 without regulation.

The LED drivers 176 in an example may be 1.5-A step-down (buck) current regulators with an integrated MOSFET to drive high current LED elements 145. Available with 42- and 60-V (HV) input ranges, these LED drivers operate at a user-selected fixed frequency with peak-current mode control and deliver excellent line and load regulation. In an example, each LED driver 176 features separate inputs for analog and pulse width modulation (PWM) dimming for brightness control without compromise, which allows achieving contrast ratios of greater than 100:1. The PWM input is compatible with low-voltage logic standards for easy interface to a broad range of microcontrollers (MCUs). The analog LED current set-point is adjustable from 0 V to 300 mV using an $I_{ADJ}$ input with an external 0- to 1.8-V signal. For multi-string applications using two or more LED drivers 176, the internal oscillator can be overdriven by an external clock to ensure that all of the converters operate at a common frequency, thereby reducing the potential for beat frequencies and simplifying the system electromagnetic interference (EMI) filtering. An adjustable input undervoltage lockout (UVLO) with hysteresis provides flexibility in setting start and stop voltages based upon supply voltage conditions.

Figure 14:
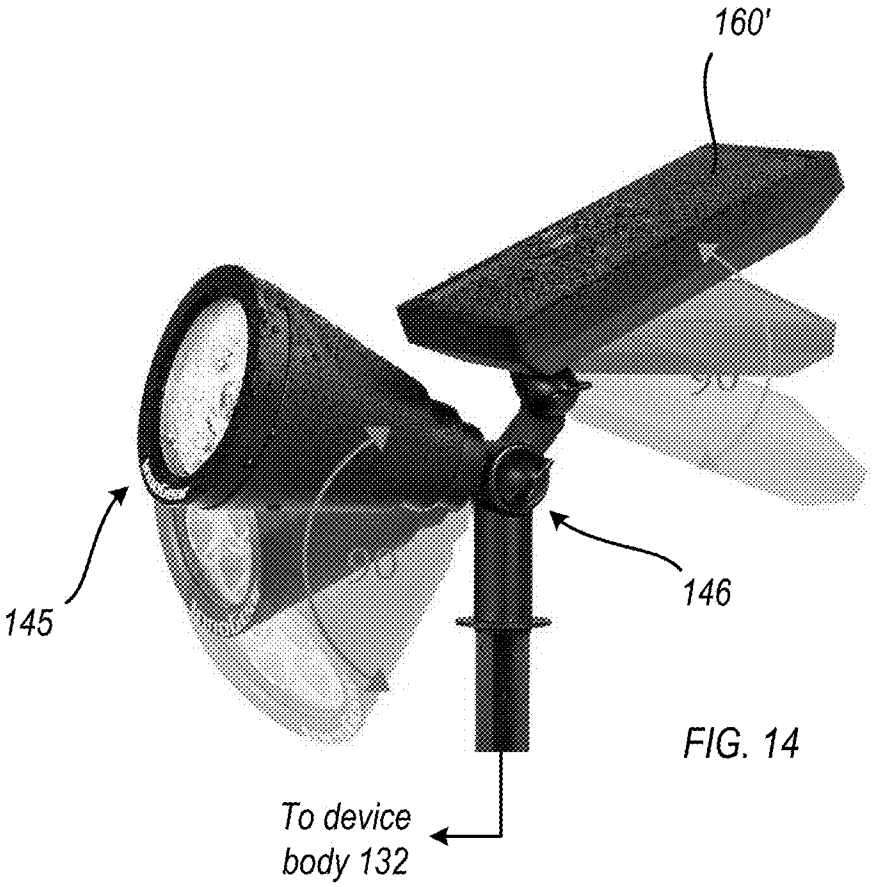
FIG. 14 is a plan view showing an articulating member and a solar panel power source between light source and device body according to another embodiment.
Figure 13:
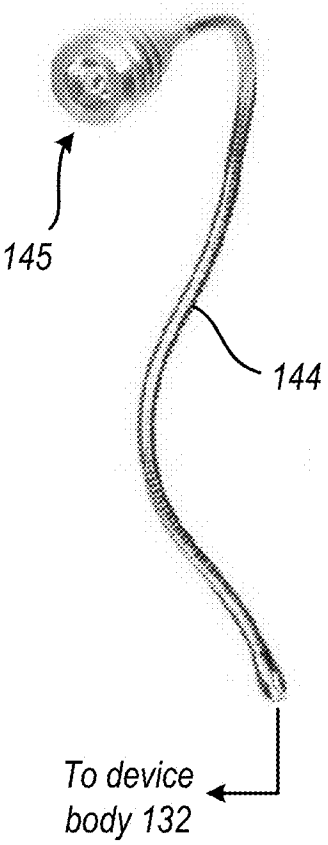
FIG. 13 is a plan view showing an articulating member between light source and device body according to one embodiment.

FIG. 13 is a plan view showing an articulating member between light source and device body according to one embodiment, and FIG. 14 a plan view showing an articulating member and a solar panel power source according to another embodiment. In one example implementation, the light source of 145 of illumination unit 140 is fixed at a specific angle so as to direct light onto the signage 150 at that fixed angle. Alternatively, the illumination unit 140 may include articulating member which enables variable adjustment to the angle at which light is emitted onto the signage. As shown by FIG. 13, in one example the articulating member may be embodied as an elongate flexible tube 144 arranged between the light source of the illumination unit and body of the at least one fastener device.

Flexible tube 144 is flexible and bendable to a wide variety of different shapes so that illuminating light produced by LED elements 145 with head 148 can be directed in any of a wide range of desired directions. Light can be directed generally in any direction relative to device body 132 by bending flexible tube 144 appropriately, including to angles up to and/or substantially exceeding up to about ±180° relative to the straight tube position illustrated, so as to direct light in any radial direction substantially exceeding, e.g., the directions of radials of a more than 180° hemisphere centered proximate the base 149 of tube 144 where it is attached to device body 132. In another example configuration (as shown in FIG. 14) the articulating member is a pivot coupling 146. FIG. 14 further shows the alternate power source for system 100. Instead of batteries 160, a solar panel setup 160' may be employed to power PCB 170 and illumination unit 140.

The fastener device 130, inclusive of its device body 132, housing 133, fastening elements 135, and illumination unit 140 are sealed and protected against corrosion so as to be weatherproof. This may done as part of the manufacturing process or post-production. In one example, and for corrosion protection one or more of these parts may be fabricated from a galvanized metal such as 316S-grade stainless steel or a substrate thereof, or formed of a multi-layer protection system. Examples include employing G90 galvanizing, which provides a pre-fabrication of housing 133 and/or hot-dipped coating on the fastening elements 135 of 0.90 ounces of zinc per square foot of surface area measured in accordance with ASTM A 653.b. Another process is triple-zinc galvanizing provides a prefabrication coating of 1.85 (G-185) ounces of zinc per square foot of surface area measured in accordance with ASTM A 653. A further hot-Dip Galvanized process is a coating that provides an after-fabrication hot-dipped zinc coating on the metal housing 133 and fastening elements 135. An example of a multi-layer process is the Gold Coat is a proprietary multi-layer protection system. It is comprised of an organic top coat barrier layer and a zinc layer placed over a steel substrate. Any penetrations in housing 133 (such as for the LED elements 145, photocell 143, motion sensor 147, etc. may be sealed with elastomeric elements such as O-rings, grommets, and the like. As an alternative to metal, the device body 132, housing 133, fastening elements 135, and illumination unit 140 may be composed of an elastomeric weather-resistant synthetic material such as a hard plastic.

As shown in FIGS. 3 and 5-9, the example embodiments are also directed to a fastening device with integral illumination (unit 140) for attaching first and second objects to one another other than simply signage (such as a sign poster or placard) to a supporting structure, frame or bracket. These figures illustrate the device body 132 with fastening elements 135 attached to or integrated as part of the body 132. Device body incorporates the illumination unit 140, which is integrally formed as a portion thereof and configured to direct light onto one or both of the connected objects. The battery or solar-powered light source 145 (LED elements) can direct light at a fixed angle, or be configured for variable adjustment to the angle at which light is emitted thereon. The device body 132 may include a motion sensor 147 on housing 133 that energizes its light source 145 upon detected movement. This may be instead of or in addition to incorporation of a photocell 143 which provides automatic turn-on at dusk/night and turn-off at sunrise.

The example embodiments having been described, it is apparent that such have many varied applications. For example, although system 100 has been described in reference to a frame structure attached to ground or a vertical wall surface, it is foreseen that the frame structure could be attached to a ceiling. In other examples, the example embodiments may be applicable but not limited to connection to various devices, structures and articles.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. A sign illumination system, comprising:

a frame structure configured to support signage thereon or therein, the frame structure including a generally rectangular frame and one or more vertical extensions adapted to be anchored in a ground surface or on a vertical wall surface, and at least one fastener device having a body with one or more fastening elements thereon adapted to be attached to the signage for supporting the signage, the at least one fastener device attached between one or more sides of the rectangular frame and the signage, the body further including an illumination unit integral therewith that is configured to direct light onto the signage.

2. The system of claim 1, wherein the frame structure further comprises a vertical support post adapted to be anchored in the ground surface with a perpendicular arm attached thereon.

3. The system of claim 1, wherein a portion of the body of the at least one fastening device is integral with the frame structure.

4. The system of claim 1, wherein a portion of the body of the at least one fastening device includes one or more of the fastening elements thereon so as to be removably attachable to a portion of the frame structure.

5. The system of claim 1, wherein the illumination unit directs light onto the signage at a fixed angle, or is configured for variable adjustment to the angle at which light is emitted thereon.

6. The system of claim 1, wherein the illumination unit further includes an articulating member which enables variable adjustment to the angle at which light is emitted onto the signage.

7. The system of claim 6, wherein the articulating member is embodied as an elongate flexible tube arranged between the light source of the illumination unit and body of the at least one fastener device, or embodied as a pivot coupling.

8. The system of claim 1, wherein the illumination unit includes one or more LED elements.

9. The system of claim 8, wherein the one or more LED elements are battery-powered or solar panel-powered.

10. The system of claim 1, wherein the illumination unit is configured with functionality providing automatic turn-on at night and turn-off at sunrise.

11. The system of claim 1, wherein the illumination unit includes a motion sensor that energizes the light source upon detected movement.

12. The system of claim 1, wherein the one or more fastening elements on the body of the at least one fastener device incorporate features of a group of fasteners comprising single or double-sided carabiner clips, S-shaped clips, spring clips, H or Y-shaped rider clips, eye-hook screws.

13. A combination, comprising:

a fastener adapted to couple a frame structure and signage together, the fastener having a body and one or more fastening elements thereon, the fastener attached between one or more sides of the rectangular frame and the signage, and an illumination unit removably coupled to the fastener, the illumination unit further including:

one or more LED elements that are battery-powered or solar panel-powered, functionality providing automatic turn-on at night and turn-off at sunrise, and a motion sensor that energizes its light source upon detected movement.

* * * * *